US006315049B1

(12) United States Patent
Hickey et al.

(10) Patent No.: US 6,315,049 B1
(45) Date of Patent: Nov. 13, 2001

(54) MULTIPLE LINE HYDRAULIC SYSTEM FLUSH VALVE AND METHOD OF USE

(75) Inventors: Kurt A. Hickey, Humble, TX (US); Mark D. Hamilton, Aberdeen; Nigel Leggett, Andover, both of (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/401,239

(22) Filed: Sep. 23, 1999

Related U.S. Application Data

(60) Provisional application No. 60/103,353, filed on Oct. 7, 1998.

(51) Int. Cl.[7] ..... E21B 34/10

(52) U.S. Cl. ..... 166/375; 166/332.1; 251/325

(58) Field of Search ..... 166/311, 316, 166/332.1, 373, 375; 251/324, 325; 137/597

(56) References Cited

U.S. PATENT DOCUMENTS

| | | | | |
|---|---|---|---|---|
| 2,196,202 | * | 4/1940 | Corbin . | |
| 3,777,813 | * | 12/1973 | Dendy et al. . | |
| 3,993,100 | * | 11/1976 | Pollard et al. . | |
| 4,037,622 | * | 7/1977 | Osheroff et al. | 137/597 |
| 4,345,622 | * | 8/1982 | Henningsson . | |
| 4,799,462 | * | 1/1989 | Tittizer et al. . | |
| 4,977,917 | * | 12/1990 | Adams | 137/597 |
| 5,008,773 | * | 4/1991 | Yoshida et al. | 361/187 |
| 5,456,078 | | 10/1995 | Goloff | 60/327 |
| 5,494,102 | * | 2/1996 | Schulte | 166/105.6 |
| 5,730,359 | * | 3/1998 | Wurth | 239/66 |

FOREIGN PATENT DOCUMENTS

| | | | |
|---|---|---|---|
| 2 292 188 | | 10/1997 | (GB) . |
| 2 311 822 | | 10/1997 | (GB) . |
| 92/02712 | * | 2/1992 | (WO) . |

* cited by examiner

*Primary Examiner*—David Bagnell
*Assistant Examiner*—Jennifer Dougherty
(74) *Attorney, Agent, or Firm*—Cantor Calbourn LLP

(57) ABSTRACT

A flush valve for a multiple line hydraulic system includes a bifurcated manifold, the bifurcation being provided by a piston actuatable hydraulically, mechanically, electrically magnetically or by fiber optic means. The piston or gate is provided with a port extending diametrically therethrough and oriented to become coaxial with an inlet and outlet of the manifold upon actuation of the piston. With the port aligned the hydraulic fluid in the system can be displaced by fresh fluid. The piston is then deactivated which results in the port becoming misaligned with the inlet and outlet of the manifold. In this condition the hydraulic system is again sealed and functions normally.

11 Claims, 1 Drawing Sheet

MULTIPLE LINE HYDRAULIC SYSTEM FLUSH VALVE AND METHOD OF USE

This application claims the benefit of an earlier filing date from U.S. Ser. No. 60/103,353, filed Oct. 7, 1998, the entire contents of which is incorporated herein by reference.

BACKGROUND OF THE INVENTION

1. Field of the Invention

The invention relates to oil field tools. More particularly, the invention relates to multiple line hydraulically operated tools and the refreshing of the hydraulic fluid thereof.

2. Prior Art

Downhole tools employing hydraulic control lines that have been deleteriously affected by contamination have been known for more than twenty years. Contamination of the hydraulic fluid can cause anything from a minor reduction in efficiency of the tool to a complete tool failure.

Common manifestations of contaminated hydraulic fluids include plugged control lines and adversely affected seal systems. To alleviate these occurrences, that many times necessitate premature workover, prior art remedies include flushing hydraulic fluid to the annulus of the well or to the tubing. While such flushing does introduce fresh hydraulic fluid, it is less than entirely effective in most situations because there is no way to be certain that all of the fluid has flushed. Moreover, the opening which allows the flushed fluid to run to the annulus or tubing can malfunction and allow contaminants into the control line thus allowing the remedy to become a source of the problem. Additionally, the flushed fluid is lost and no analysis can be undertaken on that fluid regarding type and possible source of contamination.

Other prior art systems simply attempt to build hydraulic tools capable of operating properly with contaminated fluid. While this can be considered to solve the problem it does so only when such a tool is actually successfully engineered so to do and at great expense.

Filtering systems have also been employed but with only marginal success. Some of the contaminants actually are caused by an incompatibility between the hydraulic fluid and the elastomeric compounds in the system. When this is a cause, merely filtering the fluid only solves part of the problem. A failure is still inevitable because of the degraded elastomers.

Thus, despite the efforts made in the prior art to alleviate the contamination problems experienced by hydraulically controlled downhole tools the oilfield industry still suffers from the need to perform early workovers and replace tools due to hydraulic control line contamination.

SUMMARY OF THE INVENTION

The above-identified drawbacks of the prior art are overcome or alleviated by the multiple line hydraulic system flush valve of the invention.

The flush valve of the invention requires at least two hydraulic control lines to provide the close loop function as intended. The valve, being selectively actuable, connects the two hydraulic control lines preferably below the deepest downhole tool so that no section of the downhole line near a tool will remain unflushed. Upon opening of the valve and the introduction of fresh hydraulic fluid into one of the connected lines, the system is flushed down that line, through the valve and up the other line back to the surface. The system provides a confirmation of complete flushing of the two lines by monitoring the fluid being forced out of the second control line. When the flushed fluid is running clean, the fluid exchange is complete. The ability to confirm completion is beneficial.

Also beneficial is the ability to test the flushed fluids for the degree of contamination thereof. Analysis of the contaminated fluid can provide insight to where the contamination is taking place and may enable a repair where replacement might be indicated in the prior art.

Finally, because the system is a closed loop, there are no designed in portions of the system that might leak contamination into the system.

BRIEF DESCRIPTION OF THE DRAWINGS

Referring now to the drawings wherein like elements are numbered alike in the several FIGURES.

DETAILED DESCRIPTION OF THE INVENTION

Figure 2:
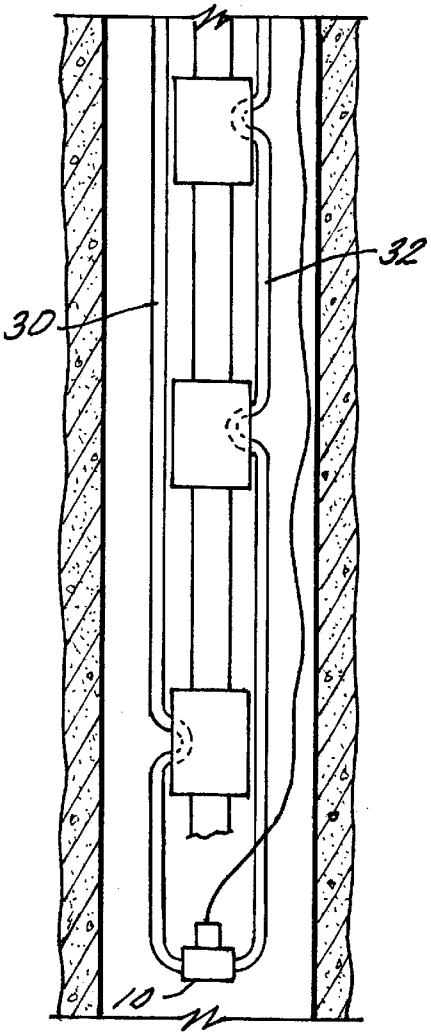
FIG. 2 is a schematic representation of a multiple hydraulic line system of the invention illustrating a preferred position for the flush valve.
Figure 1:
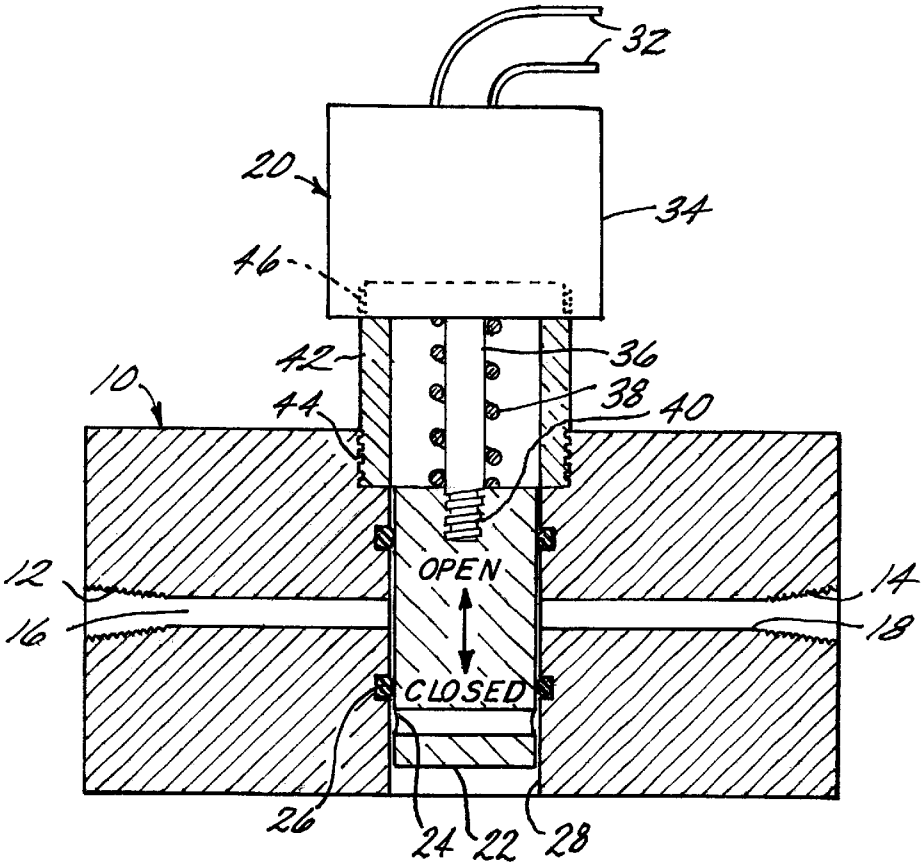
FIG. 1 is a cross section view of a valve body and manifold with connections for two hydraulic control lines.

Referring to FIG. 1, a housing 10 is provided with connections 12 and 14, preferably threaded but other reliable retention mechanisms are acceptable. Each connection 12 and 14 is intended to connect to a hydraulic line 30 or 32 (illustrated in FIG. 2). Each connection 12 and 14 are connect to a conduit. The conduits are numbered 16 and 18, respectively, in FIG. 1. Conduits 16 and 18 are directed so as to intersect with a selectively actuatable valve 20 which can selectively allow fluid to flow from one conduit 16 to the other 18 or vice versa depending upon pressure gradient. Following opening of the valve, fluid may be added to one control line at the surface and circulated down that line to the valve and then back to the surface in the other line. The valve, the, creates a loop in two otherwise independent systems.

The valve illustrated in FIG. 1 is merely one possible valve structure and it is within the scope of the invention to provide other valve assemblies with the joining factor being the ability to close or open the housing to the through passage of fluid. In the figure, valve 20 comprises a piston 22 having a flow port 24 therethrough. The flow port 24 is alignable or misalignable with conduits 16 and 18 upon movement of piston 22. In the closed position (shown) flow port 24 is misaligned with conduits 16 and 18. Preferably housing 10 provides seals 26 to fluid tightly seal piston 22 in the cylinder bore 28 thus reliably and completely isolating conduit 16 and conduit 18.

The operation of valve 20 is defined by a mechanical arrangement that effectuates the opening and closing of conduits 16, 18 through the translation of piston 22. The mechanical arrangement includes power lines 32 that provide a driving force to a motor or solenoid 34 connected to a shaft 36. A coil spring 38 is wound around shaft 36. Piston 22 is threadedly connected to shaft 36 via thread 40. Motor or solenoid 34 is mounted to housing 10 via threaded mounting support 42 threadedly connected to housing 10 at thread 44 and to motor 34 at thread 46. As will be appreciated by one of ordinary skill in the art, the operation of motor or solenoid 34 to effectuate the precise translation of the piston may be carried out electrically, mechanically, electromechanically, magnetically, hydraulically, fiber optically, or any other means.

Upon energization of motor or solenoid 34 by electric power, fiber optic light, hydraulic fluid, etc., piston 22 is moved toward motor 34 and aligns port 24 with conduits 16 and 18. Fluid pumped into one of the hydraulic lines 30 from the surface will move existing fluid through the flow port 24 into another hydraulic control line and back to the surface. The used fluid is monitored at the surface to determine when a full flush has occurred. This is confirmed when clean fluid is emerging from the second hydraulic control line. Upon such confirmation the piston is allowed to return the flow port to the misaligned (closed) position by the removal of the energizing impetus on the motor or solenoid. Once the valve is closed the two hydraulic control lines are once again operable and are free of contaminants.

At the surface the contaminated fluid is analyzed to gain insight into why it became contaminated and to take remedial measures.

It should be understood that only the simplest of the systems of the invention has been described in detail. More control lines could be collected into the housing and communicable with the same flow port or differing flow ports for each pair of controllers without departing from the spirit and scope of the invention which is to provide maintenance to a hydraulic control system by causing fluid thereon to be exchanged on a regular basis through the introduction of a selectively operable valve.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A hydraulic control line flush system incorporated into a wellbore, the system comprising:

a first hydraulic control line extending downhole into said wellbore, said first hydraulic control line containing hydraulic fluid;

a second hydraulic control line extending downhole into said wellbore, said second hydraulic control line containing hydraulic fluid;

a valve housing positioned downhole in said wellbore, said valve housing being connected to said first hydraulic control line and said second control line;

a selectively actuatable valve mounted in said valve housing, said valve selectively isolating and providing fluid communication between said first hydraulic control line and said second hydraulic control line.

2. The hydraulic control line flush system as claimed in claim 1 wherein said valve comprises:

a piston riding in a sealed bore, said piston having a flow port therein; and a selectively actuatable drive for said piston.

3. The hydraulic control line flush system as claimed in claim 2 wherein said drive is a solenoid.

4. An hydraulic control line system having at least two control lines and being located downhole in a wellbore, the system comprising:

a valve housing connected to said at least two control lines, said valve housing being disposed downhole of controllable tools disposed in said wellbore; and a selectively actuatable valve mounted in said valve housing, said valve being configured to selectively isolate and provide fluid communication between said at least two hydraulic control lines.

5. The hydraulic control line system as claimed in claim 4 wherein said valve comprises:

a piston riding in a sealed bore, said piston having a flow port therein; and a selectively actuatable drive for said piston.

6. The hydraulic control line system as claimed in claim 5 wherein said drive is a solenoid.

7. A method for maintaining hydraulic control systems downhole, the method comprising:

connecting at least two hydraulic control lines together with a valved housing located downhole at a level below a level at which a tool being controlled by said hydraulic control system is located;

energizing said valved housing to move a valve disposed in said valved housing, thereby causing fluid communication to be effectuated between said at least two hydraulic control lines; and adding fluid to an inlet of one of said at least two hydraulic control lines until fluid having a composition that is indicative of a flushed system is received at an outlet of the other of said at least two hydraulic control lines.

8. The method as claimed in claim 7 wherein said method further includes closing said valve.

9. A method for maintaining hydraulic control systems downhole, the method comprising:

connecting at least two hydraulic control lines together with a valved housing located downhole at a level below a level at which a tool being controlled by said hydraulic control system is located;

energizing said valved housing to move a valve disposed in said valve housing, thereby causing fluid communication to be effectuated between said at least two hydraulic control lines;

adding fluid to an inlet of one of said at least two hydraulic control lines; and analyzing fluid retrieved from an outlet of the other of said at least two hydraulic control lines.

10. A hydraulic control line flush system comprising:

a first hydraulic control line containing hydraulic fluid;

a second hydraulic control line containing hydraulic fluid;

a valve housing connected to said first hydraulic control line and said second hydraulic control line; and a selectively actuatable valve mounted in said valve housing, said valve selectively isolating and providing fluid connection between said first hydraulic control line and said second hydraulic control line, said selectively actuatable valve comprising, a piston riding in a sealed bore, said piston having a flow port therein, and a selectively actuatable optical solenoid drive for said piston.

11. An improved hydraulic control line system having at least two control lines and being located downhole in a wellbore, the system comprising:

a valve housing connected to said at least two control lines, said valve housing being disposed downhole of controllable tools disposed in said wellbore; and a selectively actuatable valve mounted in said valve housing, said valve being configured to selectively isolate and provide fluid communication between said at least two hydraulic control lines, said selectively actuatable valve comprising, a piston riding in a scaled bore, said piston having a flow port therein, and a selectively actuatable optical solenoid drive for said piston.

* * * * *